United States Patent [19]

Tomaszewski

[11] Patent Number: 4,617,095

[45] Date of Patent: Oct. 14, 1986

[54] ELECTROLYTIC POST TREATMENT OF CHROMIUM SUBSTRATES

[75] Inventor: Thaddeus W. Tomaszewski, Dearborn, Mich.

[73] Assignee: OMI International Corporation, Warren, Mich.

[21] Appl. No.: 747,599

[22] Filed: Jun. 24, 1985

[51] Int. Cl.[4] ..... C25D 11/36; C25D 11/38

[52] U.S. Cl. ..... 204/41; 204/56.1

[58] Field of Search ..... 204/56 R, 41, 140; 148/6.16

[56] References Cited

U.S. PATENT DOCUMENTS

| | | | |
|---|---|---|---|
| 3,032,487 | 5/1962 | Yonezaki et al. | 204/56 R |
| 3,118,824 | 1/1964 | Yonezaki et al. | 204/56 R |
| 3,330,744 | 7/1967 | Wright et al. | 204/56 R |
| 3,798,074 | 3/1974 | Esler et al. | 148/6.16 |

FOREIGN PATENT DOCUMENTS

| | | | |
|---|---|---|---|
| 649994 | 11/1964 | Belgium | 204/56 R |
| 1380242 | 10/1964 | France | 204/56 R |
| 2090 | 1/1970 | Japan | 148/6.16 |
| 17342 | 2/1977 | Japan | 204/56 R |
| 876127 | 8/1961 | United Kingdom | 204/56 R |
| 1031792 | 6/1966 | United Kingdom | 204/56 R |

*Primary Examiner*—G. L. Kaplan

*Attorney, Agent, or Firm*—Richard P. Mueller

[57] ABSTRACT

An improved process and aqueous electrolyte for imparting improved corrosion resistance to chromium substrates, and particularly nickel-plated substrates having a chromium plating thereover deposited from a trivalent chromium electrolyte. The post-treating solution contains solution soluble and compatible hexavalent chromium compounds including chromates and dichromates present in an amount sufficient to deposit a protective film on the chromium substrate and phosphate ions present in an amount of about 2.5 g/l up to the limit of solubility in the electrolyte. The electrolyte optionally, but preferably, further contains a buffering agent present in an amount to stabilize the pH of the solution within a range from about 2.5 up to about 10. Optionally, the electrolyte further contains at least one metal ion selected from the group consisting of nickel, cobalt and mixtures thereof in an amount up to about 2 g/l, conductivity salts to enhance the electrical conductivity of the solution and a compatible wetting agent. In accordance with the process aspects of the invention, the chromium plated substrate is immersed in the electrolyte and is cathodically electrified to effect the passage of current through the solution between an anode and the substrate at an average cathode current density below that at which metallic chromium is deposited on the substrate for a period of time sufficient to deposit a protective film of the desired thickness thereon.

12 Claims, No Drawings

ELECTROLYTIC POST TREATMENT OF CHROMIUM SUBSTRATES

BACKGROUND OF THE INVENTION

The present invention broadly relates to a process and electrolyte for imparting improved corrosion protection to chromium substrates, and more particularly, for improving the corrosion resistance of chromium plated articles having a nickel plating underlying the chromium overplate. More specifically, the present invention is particularly applicable for improving the corrosion resistance of nickel plated substrates having an overlying chromium plating deposited from trivalent chromium electrolytes.

A variety of compositions and processes have heretofore been used or proposed for use to impart improved corrosion resistance to chromium plated substrates to retard the formation of rust spots when exposed to corrosive environments. The imposition of more stringent requirements on the corrosion resistance of such chromium plated substrates such as used as components of automobiles in which they are subjected to cyclical corrosive environments has occasioned the need for still further improvements in the corrosion resistance of such substrates. Conventionally, such substrates comprise a ferrous base metal such as steel which is provided with a semi-bright to bright nickel plating thereover followed by a relatively thin chromium overplate. Chromium platings electrolytically deposited from conventional hexavalent chromium electrolytes are generally characterized as passive and nonporous and provide satisfactory corrosion protection in many instances. Because waste effluents containing residual hexavalent chromium ions have become disfavored because of environmental considerations necessitating stringent waste treatment, chromium electrolytes have been commercially introduced in which the chromium constituent is substantially all in the trivalent state. It has been observed that chromium platings electrodeposited from such trivalent chromium electrolytes do not effectively passivate the surface as well as chromium deposits from hexavalent chromium electrolytes and the trivalent chromium electroplated deposits also have a tendency to be porous. Accordingly, nickel-plated substrates having an overlying chromium plating electrodeposited from a trivalent chromium electrolyte have been found to be inferior in corrosion resistance to similar substrates plated with a hexavalent chromium electrolyte.

There has, accordingly, been a need for an improved composition and process for the electrolytic post treatment of chromium-plated substrates which enhances the corrosion resistance thereof thereby substantially increasing the useful operating life of the substrate in spite of exposure to corrosive environmental conditions. While the benefits of the present invention are particularly pronounced in connection with chromium platings deposited from trivalent chromium electrolytes, beneficial results are also achieved employing the present invention on conventional chromium plating electrodeposited from hexavalent chromium electrolytes.

Compositions and processes of the types heretofore known have primarily focused on the improvement in corrosion resistance of various metallic substrates including those plated with chromium from a hexavalent chromium electrolyte. For example, U.S. Pat. No. 2,314,341 has suggested a method and composition for improving the corrosion resistance of magnesium substrates employing an aqueous alkaline solution in which the part is anodically charged or is connected to an alternating current source and the solution contains a metal ion capable of forming a compound with the magnesium substrate under the conditions of electrolysis including chromates, dichromates, permanganates, borates, silicates, sulfates, fluorides, phosphates and molybdates.

U.S. Pat. No. 2,746,915 discloses an electrolytic treatment of hexavalent chromium-plated substrates employing an aqueous acidic solution containing hexavalent chromium compounds but which are devoid of any buffering agents to enhance the clarity of the protective film produced in accordance with the practice of the present invention. U.S. Pat. No. 2,755,242 discloses a treatment for chromium-plated aluminum in which the article is anodically electrified in an aqueous solution containing 1 gram per liter of chromic acid. U.S. Pat. No. 3,574,069 discloses a process for applying a dual chromium electroplating from hexavalent chromium electrolytes on a substrate in which the second electrolyte contains a silicofluoride compound as an essential constituent. U.S. Pat. No. 3,755,091 discloses a process for electrochemically treating a chromium-plated ferrous metal strip in which a dual chromium plating is applied employing a hexavalent chromium electrolyte with an optional intervening nonelectrolytic hexavalent chromium immersion step. U.S. Pat. No. 3,928,157 describes a post treatment of a nickel-plated-chromium-plated steel substrate employing an anodic heat treatment followed by an electrolytic deposition of a synthetic polyamino resin dispersed in an aqueous solution. U.S. Pat. No. 3,966,570 describes a method of electrolytically post-treating of a chromium plated steel strip employing a hexavalent chromium electrolyte by first subjecting the chromium-plated strip to an anodic treatment in a solution containing sodium dichromate in combination with organic acids and, optionally, followed by a further cathodic electrolytic treatment in the same post-treating solution. U.S. Pat. No. 4,007,099 relates to a cathodic post treatment of a chromium plating to effect the formation of micropores in the chromium layer deposited from a hexavalent chromium electrolyte to protect the underlying substrate from electrolytic attack.

The improved process and composition of the present invention provides benefits and advantages by providing an unexpected increase in the corrosion resistance of chromium substrates, particularly chromium electro deposits deposited from a trivalent chromium electrolyte thereby substantially increasing the versatility of use of such post-treated articles as well as enhancing their corrosion resistance and decorative appearance.

SUMMARY OF INVENTION

The benefits and advantages of the present invention are achieved by an improved aqueous composition and process for the electrolytic post treatment of chromium substrates, and more particularly, for chromium platings deposited from a trivalent chromium electrolyte over an underlying bright or semi-bright nickel plating. The electrolyte comprises an aqueous solution containing bath soluble and compatible hexavalent chromium compounds such as chromates and dichromates present in an amount sufficient to form a protective film on the chromium substrate, phosphate ions present in an amount of from about 2.5 grams per liter (g/l) up to their limit of solubility in the electrolyte; optionally but preferably, a bath soluble and compatible buffering agent present in an amount sufficient to impart stability to the pH of the electrolyte such as borates, acetates, citrates, gluconates as well as mixtures of the foregoing; optionally, at least one metal ion selected from the group consisting of nickel, cobalt and mixtures thereof and hydrogen ions present to provide a solution pH ranging from about 2.5 up to about 10.

In accordance with the process aspects of the present invention, the chromium-plated substrate is immersed in the aqueous electrolyte and is cathodically charged to effect a flow of electric current through the electrolyte between an anode and the substrate for a period of time sufficient to deposit a protective film on the substrate of the desired thickness. The electrolytic post treatment can be performed employing solution temperatures of from about room temperature (65° F.) up to 170° F. or higher for time periods generally ranging from as little as 5 seconds up to about 10 minutes or longer. The average cathode current density is controlled within a range of about one up to about 50 amperes per square foot (ASF) and below that at which metallic chromium is deposited on the substrate. Solution agitation is preferred such as by employing air or mild mechanical agitation employing racks or barrel plating apparatus. Following the electrolytic post treatment, the post treated substrate is preferably subjected to a water rinse followed by a warm water rinse to remove any residual electrolyte therefrom.

Additional benefits and advantages of the present invention will become apparent upon a reading of the description of the preferred embodiments taken in conjunction with the specific examples provided.

DESCRIPTION OF THE PREFERRED EMBODIMENTS

In accordance with the composition aspects of the present invention, the aqueous electrolytic post-treating solution contains hexavalent chromium compounds present in an amount sufficient to form a protective film on the chromium substrate and phosphate ions present in an amount of about 2.5 g/l up to solubility in the electrolyte.

The hexavalent chromium compound may comprise chromate and/or dichromate introduced in the form of the acid or the bath soluble and compatible salts thereof of which the alkaline metal salts, and particularly the sodium salts comprise the preferred materials. When chromate compounds are employed, the concentration can range from as low as about 2.5 g/l up to the limit of solubility of the compound in the solution with amounts of about 4 g/l to about 20 g/l being preferred while amounts of about 10 g/l are typical. The addition of about 30 g/l of sodium chromate to the solution provides a chromate equivalent concentration of about 10 g/l. When dichromate is employed as the source of the hexavalent chromium compound, the concentration can range from about 4.5 g/l up to the limit of solubility of the compound in the solution with amounts preferably ranging from about 5 g/l to about 25 g/l. Typically, dichromate concentrations of about 18 g/l are employed which correspond to the addition of about 30 g/l of sodium dichromate dihydrate to the solution.

Typical of alternative satisfactory hexavalent chromium compounds which can be employed are rubidium chromate, rubidium dichromate, magnesium chromate heptahydrate, lithium chromate dihydrate, lithium dichromate dihydrate, cesium chromate, calcium chromate dihydrate, ammonium chromate, ammonium dichromate, potassium chromate or the like.

A further essential ingredient of the aqueous electrolyte comprises phosphate ions present in an amount of about 2.5 g/l up to saturation, preferably, in amounts of about 3 to about 12.5 g/l and typically, about 7.5 g/l. The phosphate ions can be introduced into the aqueous electrolyte employing any one or a mixture of bath soluble and compatible phosphate compounds of which the alkali metal and ammonium salts comprise the preferred materials. Typical of such phosphate compounds including various hydrated forms thereof are sodium orthophosphate, sodium hydrogen orthophosphate, sodium dihydrogen orthophosphate, sodium pyrophosphate, sodium metaphosphate, sodium triphosphate, as well as the corresponding potassium and ammonium salts of the foregoing.

In addition to the hexavalent chromium compound and phosphate ions, the aqueous electrolyte optionally but preferably further contains a buffering agent present in an amount sufficient to stabilize the pH of the aqueous solution within the desired range. Buffering agents which have been found to be particularly suitable include borates, acetates, citrates, gluconates as well as mixtures of two or more of the foregoing of which borate itself constitutes the preferred material.

The borate can conveniently be introduced in the form of boric acid or bath soluble compatible salts thereof of which alkali metal salts, particularly sodium borate constitutes a preferred material. When borate ions are employed as the sole buffering agent, the borate concentration may range from about 15 up to about 60 g/l with concentrations of from about 20 to about 40 g/l being preferred. Typically, the borate concentration is about 22 g/l.

In lieu of all or a portion of the borate buffering agent, acetate, citrate and/or gluconate can be employed in amounts up to about 80 g/l, preferably from about 22 to about 60 g/l and typically about 44 g/l. The acetate, gluconate and citrate can be introduced in the form of the acid itself as well as bath soluble and compatible metal salts of which the alkali metal salts such as sodium salts constitute a preferred material.

It has been found advantageous to employ a combination of the borate buffering agent with one or more of the acetate, citrate and gluconate buffering agents in approximately equal amounts, typically about 22 g/l borate and about 22 g/l or the acetate, citrate, or gluconate. A particularly satisfactory mixture comprises approximately equal amounts of borate and acetate which has been found to enable the use of higher average cathode current densities during the electrolytic post-treatment step without occasioning any "whiting out" or loss of clarity of the protective film in such high current density areas of the substrate being treated.

In addition to the foregoing, the aqueous solution contains hydrogen ions in an amount to provide a pH generally ranging from about 2.5 up to about 10, preferably from about 4 to about 4.5 and especially from about 4.2 to about 4.3. Appropriate adjustment of the pH of the solution can conveniently be achieved by the addition of dilute sulfuric acid or dilute sodium hydroxide or sodium carbonate solutions to the bath.

The aqueous treating solution may further preferably contain a metal ion selected from the group consisting of nickel ions, cobalt ions as well as combinations thereof. When nickel ions and/or cobalt ions are employed, their concentration can range up to about 2 g/l with concentrations of about 0.1 to about 1 g/l being preferred. Typically, the nickel and/or cobalt ion concentration is controlled at about 0.2 g/l which can conveniently be achieved by the addition of 1 g/l of nickel sulfate hexahydrate or cobalt sulfate heptahydrate to the solution.

In order to increase the electrical conductivity of the treating solution, it is desirable to include bath soluble and compatible conductivity salts which conventionally comprise alkali metal sulfates and/or chloride of which sodium sulfate itself or sodium chloride comprise preferred materials. The conductivity salt is generally employed in concentrations of from about 10 g/l up to its limit of solubility in the solution with concentrations of from about 15 up to about 50 g/l being preferred. Typically, 30 g/l of sodium sulfate has been found particularly effective.

A bath soluble and compatible wetting agent can also be optionally employed typically in concentrations up to about 1 g/l.

During use of the treating solution for the electrolytic post treatment of chromium plate substrates, it is necessary to continuously or periodically replenish the hexavalent chromium compounds in the solution as well as the nickel and/or cobalt ions and buffering agent which are consumed during the treatment. The remaining constituents must also be replenished to maintain them within the appropriate concentration range due to solution dragout which will vary depending upon the configuration of the substrate and the method of racking during the electrolytic post-treatment step.

In accordance with the process aspects of the present invention, the chromium substrate to be treated is immersed in the treating solution and is cathodically charged to effect a flow of current through the solution from an anode, preferably an insoluble anode such as carbon or graphite. The average cathode current density is controlled at a level below that at which metallic chromium is deposited on the substrate. Depending upon solution composition and temperature, average cathode current densities ranging from about 1 up to about 50 ASF can be employed with current densities of from about 2 up to about 10 ASF being preferred. Typically, an average cathode current density of about 5 ASF has been found satisfactory. The ratio of the surface area of the anode to the surface area of the cathode has not been found critical and typically an anode to cathode surface area ratio of about 2:1 has been found satisfactory for providing optimum current distribution and uniform coverage of the substrate.

Agitation of the solution during the electrolytic post treatment is preferred to avoid solution depletion at the surface of the substrate. For this purpose, air or mechanical agitation can be employed as well as agitation provided when the parts are treated in a rotating bulk processing barrel.

The time period for treatment can range from as low as about 5 seconds up to about 10 minutes or longer with time periods of about 30 seconds up to about 5 minutes being preferred. Typically, a treatment time of about 1 minute has been found satisfactory. The specific time of the post treatment will generally be dictated by the integrated processing sequence of automatic continuous plating machines in which the substrate is initally nickel plated followed by a trivalent chromium plating and finally the electrolytic post treatment. Continuous automatic machines of the foregoing type generally provide a post-treatment time of about 1 minute.

Following the electrolytic post treatment, the post-treated substrate is generally subjected to cold water rinse, preferably followed by a warm or hot water rinse in order to remove any residual treating solution therefrom.

In order to further illustrate the embodiments of the present invention, the following examples are provided. It will be understood that the examples are provided for illustrative purposes and are not intended to be limiting of the scope of the present invention as herein described and as set forth in the subjoined claims.

In each of the following examples, a pre-cleaned steel test panel measuring 3 inches by 4 inches was subjected to a full-bright nickel plating of an average thickness of about 0.0003 inch followed by water rinsing. The nickel plating bath comprised a Watts brignt nickel plating solution containing typical proprietary brightening addition agents such as a Magnum ®S bright nickel plating bath available from OMI International Corporation. During the nickel plating operation, the electrolyte was maintained at a temperature of about 140° F. at a pH of about 4 and plating was performed for a period of about 8 minutes in the presence of air agitation at an average cathode current density of about 35 ASF.

Following the nickel plating step, the nickel plated test panels were subjected to chromium plating employing a trivalent chromium electrolyte containing about 50 g/l sodium fluoroborate, 150 g/l ammonium chloride, 50 g/l boric acid, 2 g/l vanadyl sulfate, 1 milliliter per liter of a compatible wetting agent, 40 g/l of ammonium formate and 25 grams per liter of trivalent chromium ions conveniently introduced as chromium sulfate. The chromium plating operation was performed employing an electrolyte temperature of about 75° F. at a pH of about 3 to about 3.2 in the presence of air agitation. Chromium plating was performed for a duration of about 1 minute and 42 seconds with current interruption of 12 seconds on followed by 5 seconds off at an average cathode current of 100 ASF. Under these conditions, from about 8 to about 12 millionths inch of chromium plating was overplated on the nickel deposit. The resultant chromium plated panels were thereafter cold water rinsed and then subjected to an electrolytic post treatment in accordance with the following examples.

EXAMPLE 1

An aqueous eletrolyte was prepared containing 30 g/l sodium monohydrogen phosphate heptahydrate, 30 g/l of sodium dichromate dihydrate and 22 g/l boric acid. The aqueous electrolyte was adjusted to a pH of about 4.2 and controlled at a temperature of about 75° F.

The nickel and chromium plated test panels prepared as previously described were immersed in the electrolyte in the presence of mild air agitation and were cathodically charged at an average cathode current density of about 5 ASF for a period of about one minute. The / resultant test panels after water rinsing were inspected and had clear, full-bright films thereover.

EXAMPLE 2

An aqueous electrolyte was prepared containing 30 g/l potassium pyrophosphate trihydrate, 30 g/l of sodium dichromate dihydrate and 22 g/l boric acid. The electrolyte was adjusted to a pH of about 4.3 and controlled at a temperature of about 80° F.

Nickel and chromium plated test panels prepared as previously described were immersed in the electrolyte in the presence of mild air agitation and were cathodically charged at an average cathode current density of about 10 ASF for a period of one minute. The resultant post-treated test panels after water rinsing were inspected and had a clear, full-bright film thereover.

EXAMPLE 3

An aqueous electrolyte was prepared containing 7.5 g/l sodium monohydrogen phosphate heptahydrate, 7.5 g/l sodium dichromate dihydrate and 22 g/l boric acid. The electrolyte was adjusted to a pH of about 4.2 and controlled at a temperature of about 78° F.

Nickel and chromium plated test panels prepared in a manner as previously described were immersed in the electrolyte in the presence of mild air agitation and were cathodically charged at an average cathode current density of about 5 ASF for a period of one minute. The resultant test panels, after water rinsing, were inspected and had a clear, full-bright film thereover.

EXAMPLE 4

An aqueous eletrolyte was prepared containing 7.5 g/l of sodium phosphate decahydrate, 7.5 g/l of sodium dichromate dihydrate and 22 g/l boric acid. The electrolyte was adjusted to a pH of about 4.3 and controlled at a temperature of about 75° F.

Nickel and chromium plated test panels as previously prepared were immersed in the electrolyte in the presence of mild air agitation and were cathodically charged at an average current density of about 10 ASF for a period of one minute. Following the post-treatment, the test panels were water rinsed and inspected and were observed to have a clear, full-bright film thereover.

EXAMPLE 5

The aqueous electrolyte as described in Example 4 was adjusted by the addition of dilute sulfuric acid to a pH of about 2.5. Under the same conditions described in Example 4, nickel and chromium plated test panels were electrolytically post-treated and the resultant test panels were observed to have a clear, full-bright film thereover.

EXAMPLE 6

The aqueous electrolyte as described in Example 4 was adjusted by the addition of sodium hydroxide to a pH of about 10.1. Under the same conditions as described in Example 4, nickel and chromium plated test panels were electrolytically post-treated and the resultant panels were observed to have a clear, full-bright film thereover.

EXAMPLE 7

An aqueous electrolyte was prepared containing 15 g/l sodium dichromate dihydrate, 30 g/l of sodium monohydrogen phosphate heptahydrate and 22 g/l of boric acid. The electrolyte was adjusted to a pH of about 4.3 and controlled at a temperature of about 128° F.

Nickel and chromium plated test panels prepared as previously described were immersed in the electrolyte in the presence of mild air agitation and were cathodically charged at an average cathode current density of about 10 ASF for a period of about one minute. Following water rinsing, the post-treated test panels were inspected and found to have a clear, full-bright film thereover.

EXAMPLE 8

An aqueous electrolyte was prepared containing 7.5 g/l of sodium dichromate dihydrate, 30 g/l of sodium monohydrogen phosphate heptahydrate and 22 g/l of boric acid. The pH of the electrolyte was adjusted at 4.3 and controlled at a temperature of about 105° F.

Nickel and chromium plated test panels as previously described were immersed in the electrolyte in the presence of mild air agitation and were cathodically charged at an average cathod current density of about 10 ASF for a period of about one minute. Following post-treatment, the test panels were water rinsed and were observed to have a clear, full-bright film thereover.

EXAMPLE 9

An aqueous electrolyte was prepared containing 30 g/l of sodium dichromate dihydrate, 30 g/l of sodium monohydrogen phosphate heptahydrate, 1 g/l of nickel sulfate hexahydrate and 22 g/l of boric acid. The pH of the electrolyte was adjusted to about 4.2 and the temperature was controlled at about 90° F.

Nickel and chromium plated test panels as previously described were immersed in the electrolyte in the presence of mild air agitation and cathodically charged at an average cathod density of about 10 ASF for a period of about one minute. The post-treated test panels were thereafter water rinsed and were observed to have a clear, full-bright film thereover.

EXAMPLE 10

An aqueous electrolyte was prepared containing 30 g/l of sodium chromate, 30 g/l of sodium monohydrogen phosphate heptahydrate, 1 g/l of nickel sulfate hexahydrate and 22 g/l boric acid. Nickel and chromium plated test panels were post-treated in the electrolyte under the same conditions as described in Example 9 and the resultant test panels were observed to have a clear, full-bright film thereover.

The electrolytically post-treated test panels prepared in accordance with Examples 1–10 were subjected to a 5% neutral salt spray test in accordance with the procedures set forth in ASTM-B-117 Standard Method of Salt Spray Testing. In addition to the post-treated test panels, as test panel, which was not subjected to any electrolytic post-treatment was also subjected to the same corrosion test as a control for comparative purposes. The results of the corrosion test are set forth in Table 1.

TABLE 1

| Example | Hours in Neutral Salt Spray Test ASTM-B-117 | Results - Average of four test panels |
|---|---|---|
| Control | Less than 8 hours | Complete Failure |
| 1 | 88 | 0 |
| 2 | 72 | *4 fine RR spots |
| 3 | 48 | 2–10 fine RR spots |
| 4 | 72 | 10 VF RR spots |
| 5 | 72 | 1–4 fine RR spots |
| 6 | 72 | 3–5 VF ds |
| 7 | 96 | 1–8 fine RR |
| 8 | 96 | 4–6 RR |
| 9 | 72 | 0 |

TABLE 1-continued

| Example | Hours in Neutral Salt Spray Test ASTM-B-117 | Results - Average of four test panels |
|---|---|---|
| 10 | 72 | 2–4 VF ds |

Legend:
VF = Very Fine
RR = Red Rust
ds = dark spots
*Integer is average number of spots on test panel The results as set forth in Table 1 clearly evidence the superior corrosion resistance of the electrolytically post-treated test panels in accordance with Examples 1–10 in comparison to the corrosion resistance of the control which did not receive any post-treatment.

While it will be apparent that the preferred embodiments of the invention disclosed are well calculated to fulfill the objects above stated, it will be appreciated that the invention is susceptible to modification, variation and charge without departing from the proper scope or fair meaning of the subjoined claims.

What is claimed is:

1. A process for improving the corrosion resistance of a chromium-plated substrate which comprises the steps of contacting the chromium substrate with an aqueous solution which consists essentially of a solution soluble hexavalent chromium compound selected from the group consisting of chromate, in an amount of about 2.5 grams per liter up to its limit of solubility in the solution, dichromate, in an amount of about 4.5 grams per liter up to its limit of solubility in the solution and mixtures thereof, phosphate ions in an amount of about 2.5 grams per liter up to the limit of solubility in the solution, metal ions selected from the group consisting of nickel ions, cobalt ions, and mixture thereof present in an amount of 0 to about 2 grams per liter, hydrogen ions in amount to provide a pH of about 2.5 to about 10 and a buffering agent in amount at least sufficient to maintain the pH within the desired range up to about 60 grams per liter; cathodically electrifying the substrate at a cathode current density below that at which metallic chromium is deposited on the substrate to effect current to pass through the solution between an anode and the substrate for a period of at least five seconds to deposit on the substrate a protective film of the desired thickness.

2. The process as defined in claim 1 in which said chromium is present in amount of about 4 to about 20 g/l.

3. The process as defined in claim 2 in which said chromate is present in an amount of about 10 g/l.

4. The process as defined in claim 1 in which said dichromate is present in an amount of about 5 to about 25 g/l.

5. The process as defined in claim 4 in which said dichromate is present in an amount of about 18 g/l.

6. The process as defined in claim 1 in which said buffering agent is a compound selected from the group consisting of borate, acetate, citrate, gluconate and mixtures thereof present in an amount of about 20 to about 60 g/l.

7. The process as defined in claim 1 in which said solution includes hydrogen ions to provide a pH of about 4 to about 4.5.

8. The process as defined in claim 1 in which said further metal ion is present in an amount of about 0.1 to about 1 g/l.

9. The process as defined in claim 1 including the further step of controlling the temperature of said solution within a range of about 65° to about 170° F.

10. The process as defined in claim 9 including the further step of controlling the temperature of said solution within a range of about 75° to about 100° F.

11. The process as defined in claim 1 in which the step of cathodically electrifying the substrate is performed to provide an average cathode current density of about 1 to about 50 ASF.

12. The process as defined in claim 1 in which the chromium plated substrate comprises a substrate having a chromium plate electrodeposited from a trivalent chromium electrolyte overlying an underlying nickel plating.

* * * * *